United States Patent [19]

Fournier et al.

[11] 3,974,864

[45] Aug. 17, 1976

[54] DEVICE FOR LOADING AND UNLOADING CARGO VESSELS FOR CONVEYING GASEOUS, LIQUID OR FLUIDIZED SOLID MATERIALS

[75] Inventors: Pierre Fournier, Noisy-le-Sec; Andre Jules Legleye, Vernouillet; Pierre Colle, Ozoir la Ferriere; Claude Michaut, Mennecy, all of France; Boris Petrovich Timofeev; Adolf Moritsovich Alexandrov; Ruben Dzhangirovich Balaian; Leonid Ozerovich Patik; Victor Leontjevich Berezovsky; Leonid Arkadjevich Matzkin, all of Moscow, U.S.S.R.

[73] Assignees: Compagnie Des Terminaux Marins Coterm, Paris, France; Spetsialnoe Konstruktorskoe Bjuro "Transnefteavtomatika", Moscow, U.S.S.R.

[22] Filed: Sept. 18, 1974

[21] Appl. No.: 507,192

[52] U.S. Cl. ..... 141/100; 15/3.51; 15/104.06 A; 137/615; 141/387

[51] Int. Cl.² ..... B67D 5/00; F17D 1/00

[58] Field of Search ..... 9/8 P; 15/3.5, 3.51, 15/104.06 A; 114/.5 R, 230; 134/166 C, 167 C, 168 C; 137/242, 236, 268, 615; 141/1, 9, 89, 90, 94, 99, 100, 104, 234, 279, 284, 387, 388, 392

[56] References Cited

UNITED STATES PATENTS

| | | | |
|---|---|---|---|
| 2,953,158 | 9/1960 | Shea et al. | 15/104.06 A |
| 2,980,150 | 4/1961 | Bily | 141/387 |
| 3,154,118 | 10/1964 | Silveston | 141/388 |
| 3,670,785 | 6/1972 | Heiss et al. | 141/9 |
| 3,678,972 | 7/1972 | Swindler | 141/387 |
| 3,773,093 | 11/1973 | Eustace | 141/388 |
| 3,891,004 | 6/1975 | Knight | 137/615 |

*Primary Examiner*—Richard E. Aegerter
*Assistant Examiner*—Frederick R. Schmidt
*Attorney, Agent, or Firm*—Kenyon & Kenyon Reilly Carr & Chapin

[57] ABSTRACT

Device for loading and unloading cargo vessels conveying gaseous, liquid or solid materials, comprising a system of hinged on-shore conduits, selective means for connecting said conduits to stationary conduits of on-shore plants and to conduits of vessel tanks, means for cleaning said hinged on-shore conduits, the number of which is smaller than that of said stationary conduits of on-shore plants and that of conduits of vessel tanks.

5 Claims, 3 Drawing Figures

DEVICE FOR LOADING AND UNLOADING CARGO VESSELS FOR CONVEYING GASEOUS, LIQUID OR FLUIDIZED SOLID MATERIALS

The invention relates generally to a device for loading and unloading cargo vessels of conveying gaseous, liquid or fluidized solid material such as cargo vessels for conveying loose solid chemical products or oil tankers.

It is known that the unloading or loading of various products by means of a given shore plant requires the said plant to be equipped with a number of loading or unloading devices which depends upon the number of products to be loaded onto or unloaded from the vessels. There also arise pollution problems resulting from a rapid disconnection, in case of emergency, of the loading or unloading conduits connected to the vessels, the said problems being particularly important from the point of view of pollution and hazard of accidents when the products to be conveyed are crude oils, all varieties of petroleum products, agressive chemical products, liquefied gas, liquid products containing abrasives, liquid food products, granular or pulverulent products and so forth.

One of the objects of the present invention is to reliably and economically solve the aforementioned problems by means of a device for loading and unloading cargo vessels for conveying gaseous, liquid or fluidized solid materials, comprising a system of loading and unloading paths with hingedly connected conduits mounted on shore and intended to connect the tanks on the vessel to stationary on-shore plants, characterized in that it comprises selective means for connecting the loading and unloading paths, on the one hand, to the stationary conduits of the on-shore plants and, on the other hand, to the conduits of the tanks on the vessels, and means for automatically cleaning the said hinged conduits of the loading paths between two consecutive operations of loading or unloading different materials, the number of said loading and unloading paths being considerably smaller than the number of stationary conduits of the on-shore plants and the number of different materials to be loaded or unloaded.

The invention therefore allows a considerable reduction of the number of loading or unloading devices used on mooring quays or wharves or at shipping terminals, and also the importance of the constructions or set-ups and, therefore, the investments and running costs.

In addition, the invention allows a reduction of the hazards of pollution or accident consequential to emergency disconnection of the loading or unloading paths normally connected to vessel tanks.

The invention will be better understood and other features, details and advantages of the latter will appear as the following explanatory description proceeds with reference to the appended diagrammatic drawings given solely by way of example illustrating one form of embodiment of the invention and wherein.

Figure 1:
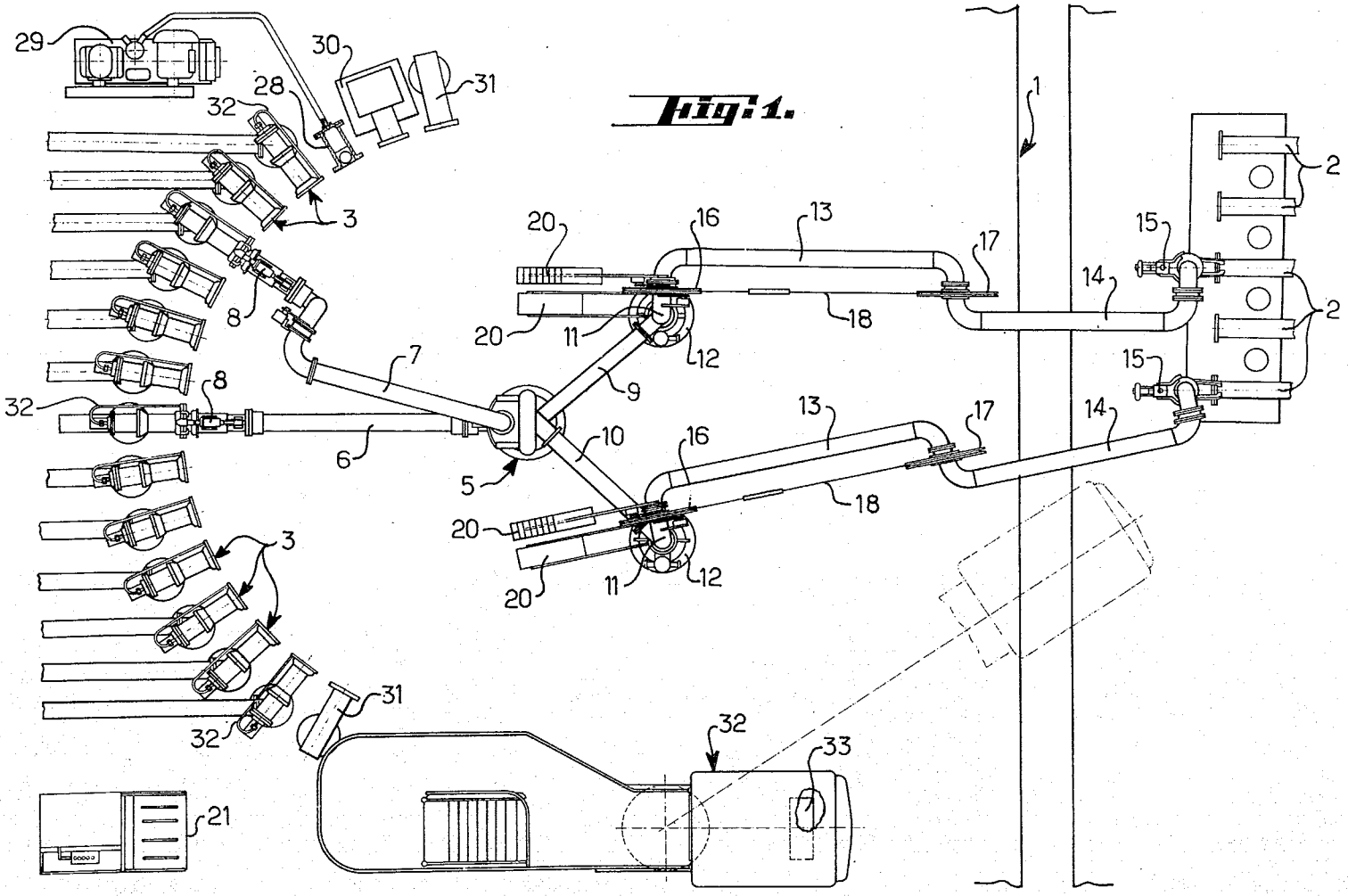
FIG. 1 is a top view of a mooring quay or wharf equipped with a loading and unloading device according to the invention.

A top view of an example of embodiment of the device according to the invention is therefore shown in FIG. 1. It is set up for example on a mooring quay or wharf 1 alongside which is berthed a cargo vessel for conveying gaseous, liquid or pulverulent or granular solid materials, of which only the ends of the loading and unloading conduits 2 connected to the tanks, holds, cisterns or reservoirs of the vessel are shown.

On the other hand, stationary plants comprising for example storage tanks for the said materials are provided on the shore at some distance from the side of the quay 1. The said plants comprise stationary loading or unloading conduits 3, the ends of which, according to the invention, are distributed along an arc of circle on the quay 1. The centre of the arc formed by the ends of the conduits 3 comprises a device 5 for hingedly connecting pipes or ducts 6 and 7, which are thus pivotable about a vertical centre line and one end of which is intended to be connected through hydraulic connectors 8 to the ends of the conduits 3 of the on-shore plants. The connectors 8 ensure mutual centring and tightening of the connecting flanges of the conduits 3 and ducts 6, 7, respectively. Furthermore, the ends of the conduits 3 are provided with a cut-off system shown more in detail in FIG. 3 and controlled from the corresponding end of the ducts 6, 7 as will be explained later.

The opposite ends of the ducts 6 and 7 are each mounted pivotally on a connecting conduit 9, 10, respectively, which is substantially parallel with the horizontal and is connected at its opposite end to a vertical conduit 11 carried by a vertical post or mast 12 mounted stationarily on the quay 1. The upper end of each vertical conduit 11 is connected to the end of a conduit 13 hingedly mounted at the upper end of the post 12, the other end of the conduit 13 being hingedly connected to another conduit 14 whose free end is provided with a device 15 for hydraulically coupling the said end of the conduit 14 to the corresponding end of the conduit 2 of a tank on the vessel. The device 15 advantageously ensures mutual centring and tightening of the ends of the conduits 2 and 14.

The hinged connections connecting each conduit 13 to a conduit 11, on the other hand, and to a conduit 14, on the other hand, allow the corresponding end of the conduits 13 and 14 to pivot about a horizontal centre line passing through the said hinged connection. Hydraulic motors (not shown), pulleys 16 and 17 and cables 18 allow the displacement of the conduits 13 and 14 in a vertical plane, whereas two counterweights 20 ensure static balancing of each group of conduits 13, 14 in any position.

The device also comprises an oil compression station 21 for feeding the hydraulic cylinders of the hydraulic coupling devices 8 and 15, and motors provided at the hinged connections of the movable conduits or ducts of the loading or unloading paths, and which allow the displacement of the ducts 6 and 7 and the conduits 13 and 14.

A movable cabin 32 is provided for the control, from a control desk 33, of all the operations of displacement of the movable conduits of the loading and unloading device, the operations of connection to and disconnection from the conduits 3 of the shore plants and the conduits 2 of the vessel tanks, reservoirs or cisterns, as well as the cleaning and disconnection operations in case of emergency.

Advantageously, the cabin 32 is so mounted as to be movable in space by means of a system of support arms moved by hydraulic motors and cylinders. The rotation and inclination of the cabin are also controlled from the control desk 33.

In the example of embodiment illustrated, the loading and unloading device according to the invention therefore comprises two loading and unloading paths, one of which is formed of the duct 6, the conduits 9, 11, 13, 14, whereas the other is formed of the duct 7 and the conduits 10, 11, 13, 14. The number of loading and unloading paths is therefore considerably smaller than the number of conduits 3 connected to the on-shore plants and to the number of gaseous, liquid or fluidized solid materials to be conveyed.

It is therefore necessary to ensure a cleaning of the said loading paths after they have served to convey a given material and must thereafter be connected to different tanks to convey other materials.

To this end, devices are provided for automatically cleaning the conduits of the loading or unloading paths, which are advantageously combined with the safety cut-off devices provided in the stationary conduits 3 connected to the shore plants.

Figure 3:
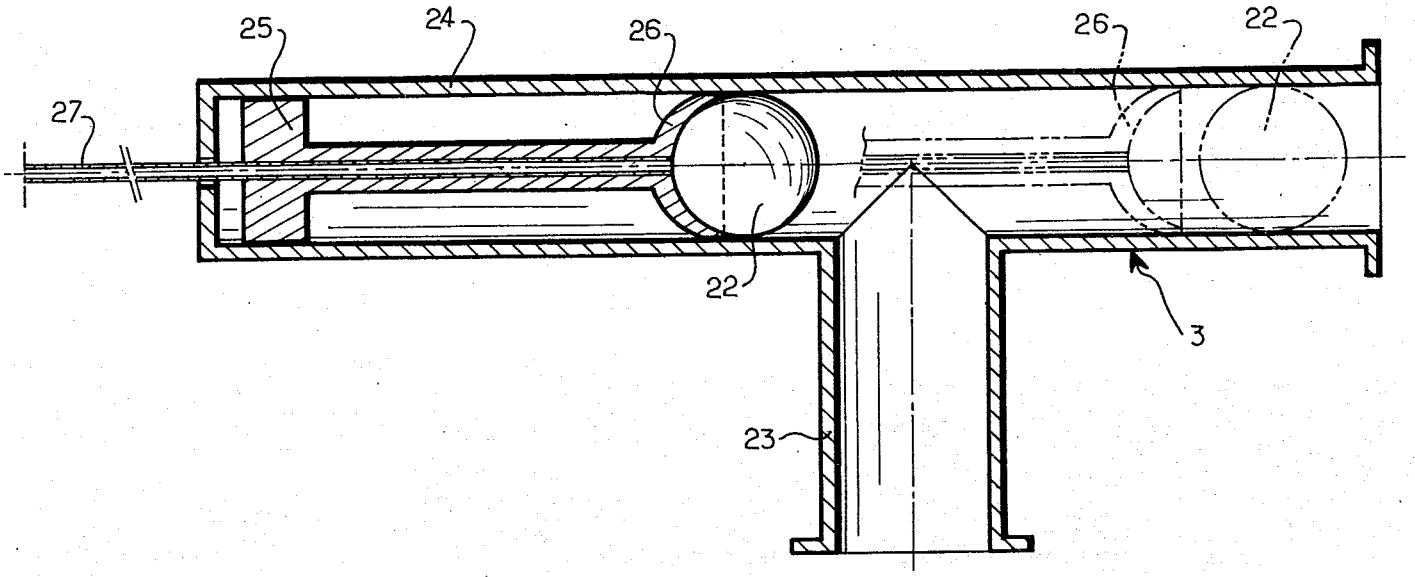
FIG. 3 diagrammatically shows a safety device forming also a cleaning device, provided at the ends of the stationary conduits of the on-shore plants.

FIG. 3 diagrammatically shows an example of embodiment of the said automatic cut-off and cleaning means.

Each stationary conduit 3 connected to an on-shore plant is for example T-shaped and comprises a horizontal cylindrical duct section 24 into which opens the end of a conduit 23 connected to the corresponding plant. The duct section 24 is provided with a flange on which is tightened the flange of the corresponding end of the said duct 6, 7 by means of a hydraulic coupler 8. The duct section 24 comprises a sliding piston 25 terminating, at its end directed towards the duct 6, 7, with a concave support member 26 intended to receive a cleaning element 22. In the position shown in full lines in FIG. 3, the piston 25 has been moved back to the end wall of the duct section 24 and has cleared the opening of the conduit 23 connected to the shore plant. In the position shown in dot-and-dash lines, the piston 25 has been moved forward to its extreme closing position where it sealingly cuts off the communication between the shore plant and the loading path. The displacement of the piston 25 is advantageously controlled from the corresponding end of the duct 6, 7, for example by means of a hydraulic cylinder (not shown) carried by this end of duct 6, 7 and a hydraulic fluid supply line 32 leading from the flange at the open end of conduit 3 to the rear of this conduit, so that no communication between the conduit 23 connected to the shore plant and the corresponding duct 6, 7 is possible unless the latter is sealingly assembled to the corresponding conduit 3.

The cleaning element 22, which may be in the form of a spherical ball or a cylindrical piston, has an outer diameter which is substantially equal to the inner diameter of the conduit 3 and the conduits 6, 7, 9, 10, 11, 13, 14 of the loading and unloading paths, in order to allow their cleaning by displacing the element 22 in the said conduits.

During conveyance of the materials to be loaded or unloaded, the element 22 is permanently applied on its concave support 26. At the end of the loading or unloading operation, compressed air or a fluid under pressure is supplied through a pipe 27 passing through the rear of the duct section 24 and through the piston 25 and opening onto the concave surface of the support 26. Under the action of the fluid under pressure, the cleaning element 22 moves to the opposite end of the loading path, i.e. to the end of the conduit 14 connected to the conduit 2 of the vessel tank, where it remains. A device (not shown) provided at the end of the conduit 14 indicates the arrival of the cleaning element. Thereafter, the latter is returned to its starting point in the duct section 24, either by supplying a fluid under pressure into the end of the conduit 14 after having closed a valve of the conduit 2 of the vessel tank, or by connecting this end of the conduit 14 to the end of an on-shore conduit 28 connected to a device 29 for the supply of fluid under pressure.

In some cases, a second cleaning may be necessary. For this reason, the device comprises (FIG. 1) the conduit 28 in which are introduced cleaning elements and which is connected to the device 29 for the supply of fluid under pressure, for example a compressor. A conduit which, like the conduit 28, is located on the arc of circle formed by the conduits 3 is connected to a bin 30 receiving the second cleaning elements after their use.

At each end of the arc formed by the conduits 3 is also located a factitious or dummy conduit 31 in which the ends of the conduits 14 are placed when the loading and unloading device is not in use.

There are also advantageously provided various means for observing and detecting the position of a vessel with respect to the quay or wharf 1 during the loading and unloading operations. The said means, used separately or in combination, may comprise ultrasonic sounders or ultra-sound emitting probes for detecting the position and distance of the vessel from the pier, hydraulic abutments or stops, for example for taking the angular position of the loading paths with respect to a vertical axis (for example the angular position of the conduits 11, 13, 14), as well as means for measuring the opening, in a vertical plane, of the compass formed by conduits 11, 13, 14. The position of the vessel with respect to the pier can thus be accurately determined in the three dimensions of space.

The said means for observing and detecting the position of the vessel are connected to the control desk 33 of cabin 32, the device comprising advantageously an automatic safety tripping circuit causing the conduits 14 to be disconnected from the conduits 2 of the vessel tanks if the vessel has moved to far from the quay and the operator has not acted in time. This automatic disconnection may take place in several steps spaced in time, so as to afford the operator some time between two consecutive steps to either interrupt the disconnection process or, if necessary, to accelerate or modify the said process.

Figure 2:
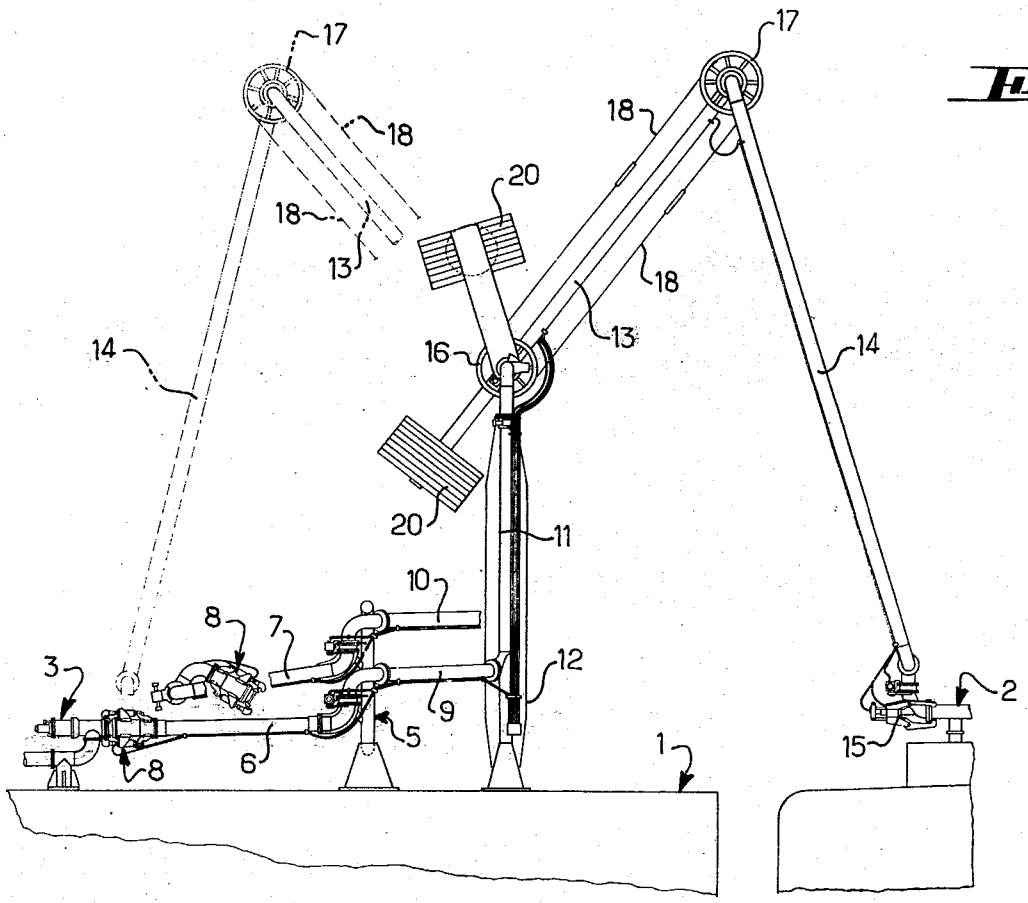
FIG. 2 is a side view of a loading and unloading path of the device according to the invention.

It will also be noted that in the example of embodiment shown in the drawings the stationary conduits 3 are distributed along an arc of circle in one and the same horizontal plane. To facilitate the connection of the loading paths to the suitable conduits 3, at least one of the ducts 6, 7, for example the duct 7, is provided with a hinged connection allowing it to pivot about a horizontal axis in proximity to its connecting end, as shown in FIGS. 1 and 2, and the said duct 7 is not in the same horizontal plane as the duct 6. Thus, when the duct 6 is connected to a conduit 3, the duct 7 can be disconnected from the conduit 3, its end can be made to pivot about the aforesaid hinged connection in order to move the duct 7 to the other side of the duct 6 and re-connect it to an appropriate conduit 3.

The loading and unloading device just described operates as follows.

According to the type of materials to be conveyed, one end of a loading path is connected to a stationary conduit 3 connected to an on-shore plant. The opposite end of the loading path is connected to the corresponding conduit of the vessel tank, reservoir or cistern, the said connections being ensured by the hydraulic couplers 8 and 15. When the fluid-tight connections are obtained, the conduits 13 and 14 are left floating to allow the same to follow the vessel in its small displacements, whereas the cut-off device provided in conduit 3 is actuated from the end of the corresponding duct 6, 7 so as to allow communication between this duct and the shore plant. The material to be conveyed is then loaded into or unloaded from the vessel in a manner known per se until the vessel tank, reservoir or cistern is completely or partially filled or emptied. A cleaning operation is then carried out, if necessary, by means of an element 22 which is sent from the on-shore stationary conduit 3 to the end of the conduit 14 and is then returned to its starting point in conduit 3. If required, a second and a third cleaning can be performed by means of the conduit 28 connected to the device 29 and of the conduit and the device 30 provided to receive the cleaning elements.

In case of trouble, for instance if the vessel has moved too far from the quay 1, the operator in cabin 32 can ensure rapid disconnection of the loading paths. This can be done, for example, by emitting light and sound alarm signals, stopping the pumping set, closing the valves and the cut-off device of the conduit 3 in case of loading, or closing the valves of conduits 2 in case of unloading, and then discharging the product contained in the loading and unloading path. Automatic disconnection of conduits 14 and their placing in floating position can take place thereafter.

These operations can also be carried out automatically under the control of the aforementioned automatic observation and detection means.

When the loading or unloading operation is over, the operator can perform a cleaning as described above, and he then actuates the ducts 6 and 7, on the one hand, and the conduits 13 and 14, on the other hand, by means of the hydraulic means provided therefor, so as to move them, respectively, to a position opposite the corresponding stationary conduits 3 and opposite the corresponding conduits 2 of the vessel tanks.

Loading and unloading of vessels are thus ensured simply, reliably and quickly owing to the use of the device of the invention.

A great number of modifications of the device are possible without departing from the scope of the invention. In particular, the on-shore stationary conduit 3 may be arranged in two parallel horizontal planes and more than two loading and unloading paths, or a single path, can be provided.

Therefore, the invention is by no means limited to the form of embodiment described and illustrated, which has been given by way of example only. In particular, it comprises all the means constituting technical equivalents to the means described as well as their combinations, should the latter be carried out according to the spirit of the invention and used within the scope of the following claims.

What is claimed is:

1. A device for loading gaseous, liquid and fluidized solid materials from on-shore plants into tanks of board vessels and inversely, comprising a system of loading lines intended to connect some of said tanks to some of said on-shore plants, the number of loading lines being smaller than the number of on-shore plants and the number of different materials to be loaded, said on-shore plants comprising a plurality of stationary conduits open at one end and connected at another end to said on-shore plants, said stationary conduits being arranged radially along an arc of circle having a central point, said loading lines comprising each a movable duct pivotably mounted at one end about a vertical axis at the said central point and provided at another end with means for connecting it to one of said stationary conduits, said loading lines further comprising each of a conduit formed by hingedly interconnected duct means movable in vertical and horizontal planes respectively, this latter conduit being connected at one end to the said movable duct at said vertical axis and being provided at an other end with means for connecting it to one of said tanks.

2. A device according to claim 1, wherein each said stationary conduit of on-shore plants comprises a piston movable within the stationary conduit between two positions, one of which allows communication between the stationary conduit and the loading line whereas the other closes the said communication, each loading line comprising means for moving a said piston within a stationary conduit onto which said loading line is connected.

3. A device according to claim 2, wherein said piston terminates on the side of the open end of the stationary conduit with means for receiving an element intended for cleaning the loading line, and said stationary conduit further comprises means for propelling the said element throughout the loading line.

4. A device according to claim 3, further comprising means for returning the cleaning element throughout the loading line toward said piston of the stationary conduit.

5. A device according to claim 1 wherein at least one said movable duct of a loading lines comprises a first duct part pivotable about said vertical axis and a second part pivotably mounted on the first part about a horizontal axis.

* * * * *